United States Patent [19]

Fujita et al.

[11] 4,315,123

[45] Feb. 9, 1982

[54] SWITCHING APPARATUS ASSEMBLY STRUCTURE

[75] Inventors: Teizo Fujita, Ibaraki; Haruo Kimura, Settsu, both of Japan

[73] Assignee: Izumi Denki Corporation, Japan

[21] Appl. No.: 138,798

[22] Filed: Apr. 9, 1980

[30] Foreign Application Priority Data

Apr. 17, 1979 [JP] Japan ..... 54-47384

[51] Int. Cl.[3] ..... H01H 9/02

[52] U.S. Cl. ..... 200/307; 200/4; 200/5 R; 200/16 A; 200/153 L; 200/291; 200/314; 200/316; 200/328

[58] Field of Search ..... 200/4, 5 R, 16 A, 153 L, 200/291, 293, 307, 328, 296, 314, 316

[56] References Cited

U.S. PATENT DOCUMENTS

| | | | |
|---|---|---|---|
| 2,814,681 | 11/1957 | White | 200/16 A |
| 3,118,026 | 1/1964 | Pusch et al. | 200/16 A |
| 3,231,706 | 1/1966 | Waldorf | 200/307 |
| 3,514,554 | 5/1970 | Boyse | 200/307 |
| 3,866,008 | 2/1975 | Teruzzi | 200/307 |
| 3,919,506 | 11/1975 | Kellogg | 200/16 A |
| 3,983,348 | 9/1976 | Kellogg | 200/314 |
| 4,250,368 | 2/1981 | Johnston et al. | 200/307 |

FOREIGN PATENT DOCUMENTS

| | | | |
|---|---|---|---|
| 1128508 | 4/1962 | Fed. Rep. of Germany | 200/328 |
| 2545369 | 4/1977 | Fed. Rep. of Germany | 200/316 |
| 2825686 | 5/1979 | Fed. Rep. of Germany | 200/307 |

*Primary Examiner*—John W. Shepperd

*Attorney, Agent, or Firm*—Pollock, Vande Sande & Priddy

[57] ABSTRACT

A switching apparatus assembly structure is disclosed in which a plurality of blocks including actuator blocks, contact blocks, a transformer blocks and direct power-supply adapter blocks are previously prepared as independent units which can be coupled together into a releasably interlocked structure, and two or more of desired ones of the above blocks are assembled to construct any desired one of smaller-size switching apparatus assemblies including a push button switch assembly, a selector switch assembly, a push button switch assembly of lockable type, a push button switch assembly with illumination, a selector switch assembly with illumination and a push button switch assembly of lockable type with illumination.

29 Claims, 47 Drawing Figures

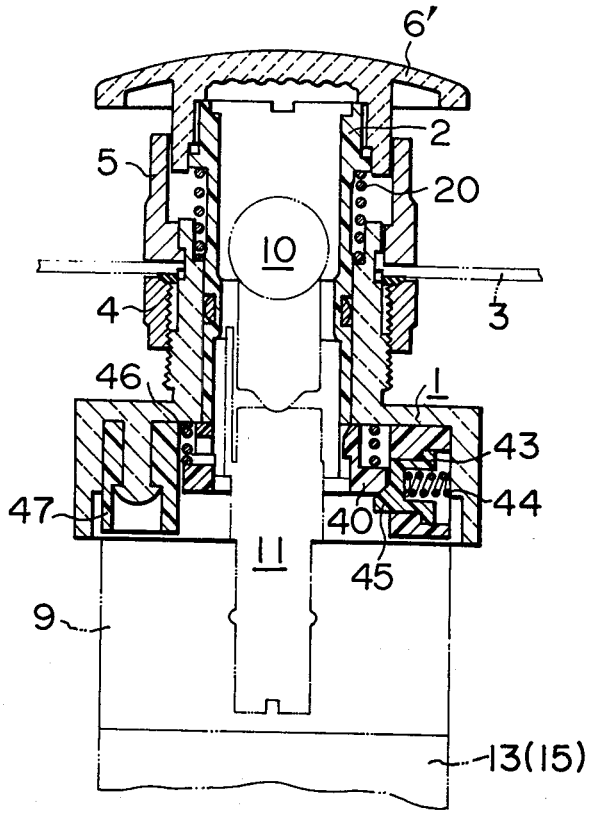
FIG. 13
FIG. 14
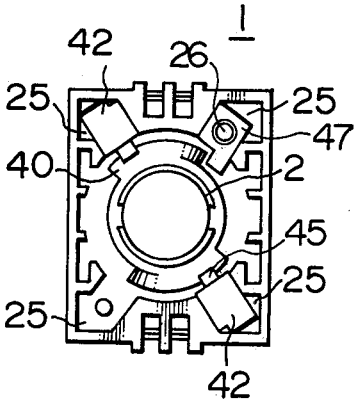
FIG. 15
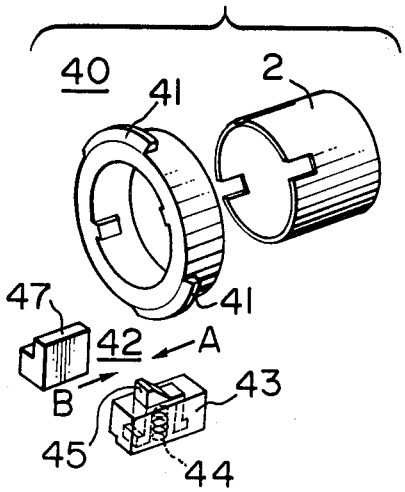

SWITCHING APPARATUS ASSEMBLY STRUCTURE

BACKGROUND OF THE INVENTION

1. Field of the Invention

This invention relates to the structure of a switching apparatus assembly.

2. Description of the Prior Art

Prior art small-size switching apparatus of various types have been basically different from one another in their design and have been individually assembled from specific parts selected for intended service. The prior art switching apparatus of small size have therefore been defective in that the requirement for the production and stock of a variety of parts to be assembled results in troublesome and time-consuming production management and stock management and results also in an increase in the costs of manufacture of production equipment such as metal molds. The prior art small-size switching apparatus have also been defective in that the efficiency of assembling is quite low because a switching apparatus of one type must be assembled from its own specific parts different from those of another type and in that extraordinarily many man-hours are required for the assembling because individual parts must be rigidly coupled and fixed together by means such as screwing and caulking.

U.S. Pat. No. 4,157,463, invented by T. Fujita, who is one of the inventors of the present invention, and assigned to the assignee of the present patent application, discloses a switching apparatus assembly structure comprising a contact block and a transformer block of a novel structure which obviates the prior art defects pointed out above and facilitates assembling of a switching apparatus. In connection with the disclosure of the switching apparatus assembly structure in which such a contact block and such a transformer block are coupled in multiple stages in the axial direction, it is also strongly demanded to obviate the structural defect of the manually operated actuator mechanism used for actuating the contact mechanism.

SUMMARY OF THE INVENTION

It is an object of the present invention to facilitate assembling of a small-size switching apparatus assembly such as a push button switch assembly, a selector switch assembly, a push button switch assembly of lockable type, a selector switch assembly with illumination or a push button switch assembly of lockable type with illumination, by suitably combining a small number of different parts selected from a stock of such parts prepared previously for the assembling purpose.

It is another object of the present invention to facilitate assembling of any desired one of the small-size switching apparatus assemblies above described by previously preparing a plurality of blocks including an actuator block, a contact block, a transformer block, and a direct power-supply adapter block as independent units which can be coupled together into a releasably interlocked structure and assembling two or more of desired ones of the above blocks including at least the actuator block and the contact block.

It is still another object of the present invention is to construct the actuator block so that it can be used in common to the assembling the all of the small-size switching apparatus assemblies thereby facilitating the stock management and reducing the costs of manufacture of the metal molds.

In accordance with the present invention, there is provided a switching apparatus assembly structure having a central axis and comprising at least one first block provided with a contact mechanism and adapted to be coupled to others in a multi-stage fashion, and a second block provided with an actuator mechanism for actuating the contact mechanism, the first block and the second block being detachably coupled to each other in the direction of the central axis, wherein the first block comprises: a first casing of a generally box-like form having its central axis registering with the central axis, at least one electrical contact means accommodated within the first casing, external lead-out terminal means electrically connected to the contact means, and first engaging means provided on the first casing for detachably coupling the first block to another block to be adjoined to the first block in the direction of the central axis; and wherein the second block comprises a second casing having its central axis registering with the central axis, the second casing including a hollow box-shaped section in the direction of the central axis, the box-shaped section opening in a direction remote from the cylindrical section with respect to the central axis to define a hollow space divided into a substantially circular central cavity and small cavities located at the four corners of the box-shaped section and communicating with the central cavity, the hollow space of the cylindrical section and the central cavity of the box-shaped section communicating with each other to define an accommodation space extending through the second casing in the axial direction, manually-operated cylindrical actuator means movably accommodated within the accomodation space for turning on and off the contact means by actuating the same, and second engaging means cooperating with the first engaging means for detachably coupling the second block to the first block adjoining thereto.

BRIEF DESCRIPTION OF THE DRAWINGS

Other objects, features and meritorious effects of the present invention will become apparent from the following detailed description of preferred embodiments thereof taken in junction with the accompanying drawings, in which:

FIGS. 1A to 1D are perspective views of independent units assembled to form an embodiment of the small-size switching apparatus assembly according to the present invention, in which FIG. 1B shows contact blocks and a transformer block which may be selectively coupled to the lower end of an actuator block shown in FIG. 1A, and FIGS. 1C and 1D show another transformer block and a direct power-supply adapter block respectively which may be coupled in place of the transformer block shown in FIG. 1B;

FIG. 13 is a longitudinal sectional elevation view of part of an embodiment of the push button switch assembly of lockable type or push button switch assembly of lockable type with illumination, according to the present invention;

FIG. 14 is a bottom plan view of the actuator block in the push button switch assembly of lockable type shown in FIG. 13, with the switch actuator mechanism being mounted in position;

FIG. 15 is an exploded perspective view showing the relation between the pressure imparting member and the actuator element and also showing the locking means and stopper means in the push button switch assembly of lockable type shown in FIG. 13;

DESCRIPTION OF THE PREFERRED EMBODIMENTS

Referring to FIGS. 1A to 1D showing an embodiment of the switching apparatus assembly according to the present invention, it comprises a plurality of blocks as described presently.

Figure 1A:
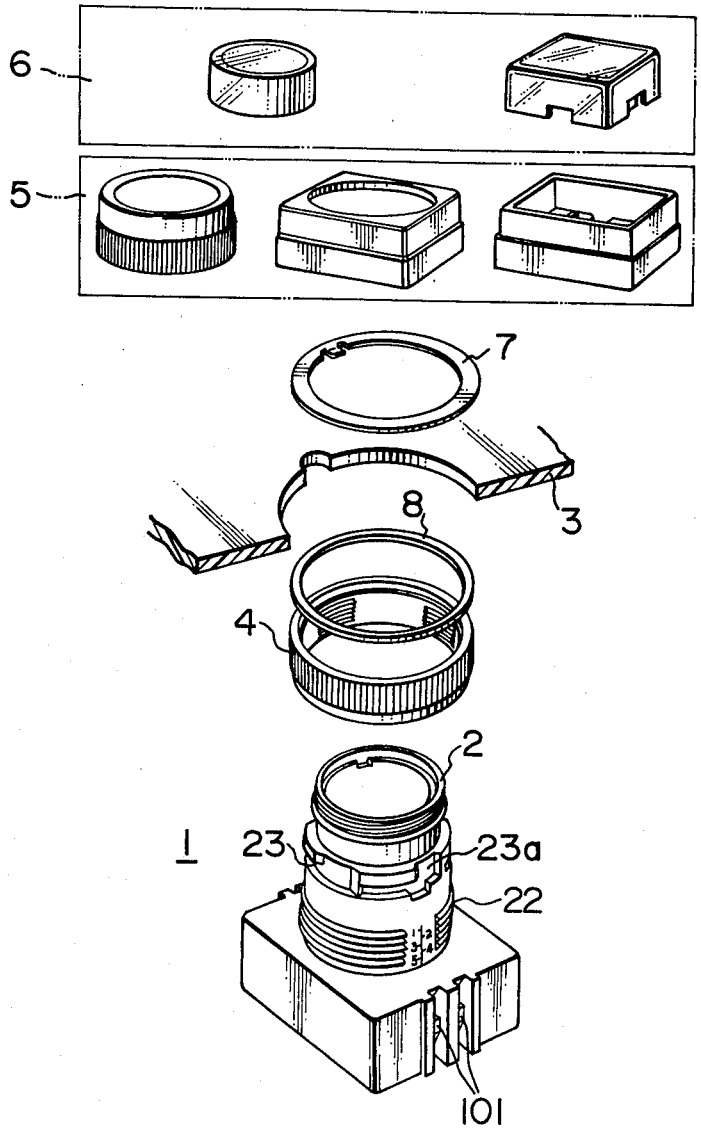

Referring first to FIG. 1A, an actuator block 1 is hollow cylindrical in its front section and hollow box-shaped in its rear section to define therein a central accommodation space extending through the actuator block 1 in its axial direction. A hollow cylindrical actuator element 2 of a switch actuator mechanism is movably received within this accommodation space so as to make linear movement along or to make turning movement around the longitudinal axis of the actuator block 1. A pressure imparting member 21 described later is also included in this switch actuator mechanism. The actuator block 1 is mounted on a supporting frame 3 such as a panel by use of mounting means including a panel-thickness adapter ring 4 and a suitable bezel 5 selected from a variety of them as shown. A desired push button 6 selected from a variety of them as shown in mounted on the upper end of the actuator element 2, and a locking ring 7 locks the actuator block 1 against rotation relative to the panel 3. A rubber washer 8 is inserted in the upper end opening of the panel-thickness adapter ring 4.

Figure 1B:
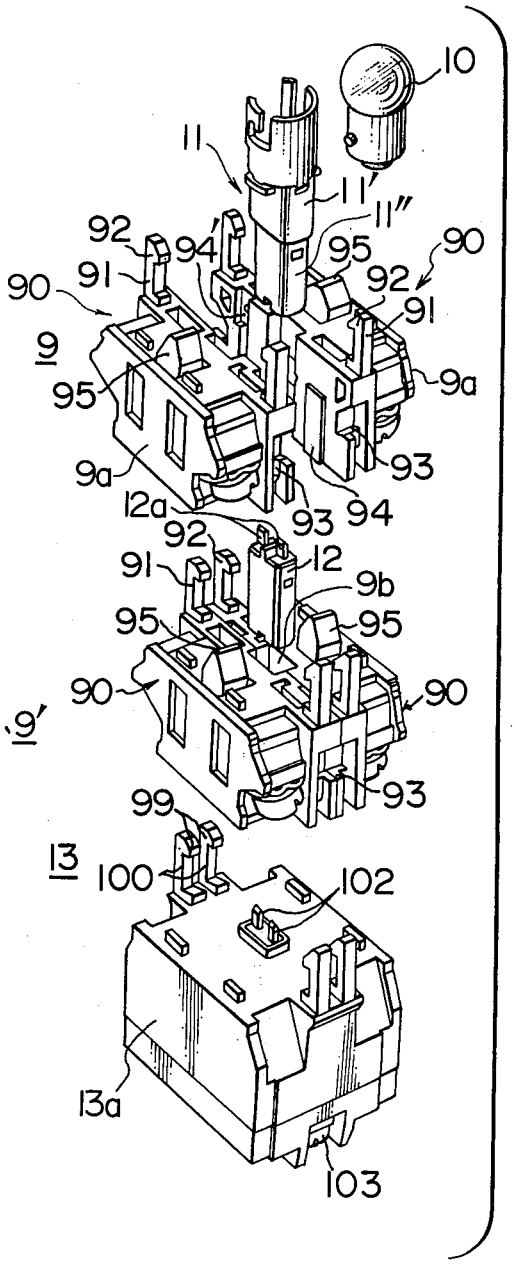

Referring to FIG. 1B, a generally box-shaped contact block 9 has a pair of same-shaped block sections 90, 90 each having a raised portion 94 and a depressed portion 94′ complementarily on one of the side faces of its casing 9*a*. Another contact block 9′ is the same one as the block 9 and coupled to the block 9 if desired. When a pair of such contact block sections 90 and 90 are joined by engagement between their mating raised and depressed portions 94 and 94′, a reception space or through hole 9*b* is defined therebetween (as seen in the block 9′) so that the lower portion 11″ of a lamp holder 11 adapted to hold an illumination lamp 10 on its upper end can be removably received in this through hole 9*b* in the block 9 or a connection conductor holder 12 holding connection conductor therein can be removably received in this reception space 9*b* in the block 9′. The holder 12 can be removably connected with the holder 11. Each of the contact block casings 9*a* is provided with a pair of couplers 91 which upstand from the upper end edges of the opposite side faces thereof and are formed at their upper ends with respective hook portions 92 directed inward toward each other. Directly beneath the couplers 91, each of the contact block casings 9*a* is formed with a pair of engaging portions 93 which are engageable with the hook portions 92 of the couplers 91 of another contact block 9′, when such an additional contact block is used, to be coupled to that contact block 9 or with hook portions of the same shape provided on, for example, a transformer block 13 or the like which will be described later. Similarly, the casing of the actuator block 1 (FIG. 1) is also formed at opposite side faces of its box-shaped rear section with engaging portions 101 engageable with the hook portions 92, so that the contact block 9 or a transformer block 14 (which will be described later) can be coupled to the actuator block 1 in a releasably interlocked fashion by engagement between the engaging portions 101 and the hook portions 92.

Referring to FIG. 1B, a transformer block 13 comprises a casing 13*a* and a conventional transformer of small size displaced within the casing 13*a*. Two pairs of couplers 100 upstand from upper central end edge portions of opposite side faces respectively of the casing 13*a* and are formed at their upper ends with respective hook portions 99 directed inward toward each other. The coupler 100 is similar to the coupler 91 and releasably engages with the engaging portion 93 of the contact block 9 (or contact block 9' when block 9' is additionally used). A pair of secondary lead-out terminals 102 of the transformer extend outward from a substantially central area of the upper face of the casing 13*a* of the transformer block 13. A pair of input terminals 103 of the transformer are disposed at the lower ends of the respective side faces of the casing 13*a*.

Figure 1C:
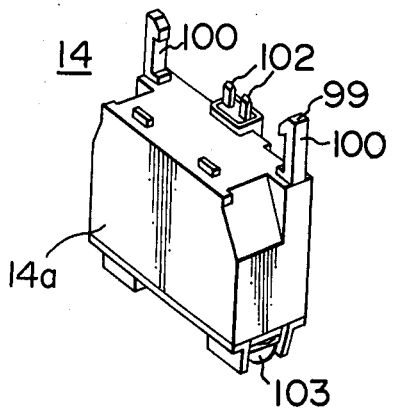
Figure 25:
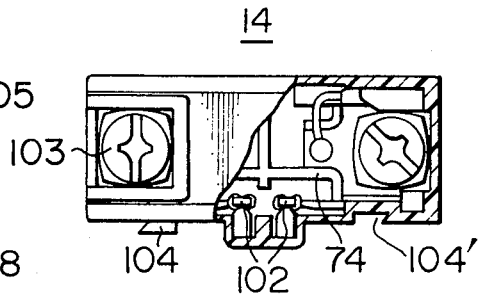
FIG. 25 is a partly cut-away, bottom plan view of the transformer block shown in FIG. 24.

Referring to FIG. 1C, another transformer block 14 of flat type is the same in its function as that of the transformer block 13 and has a transverse width which is about ½ of that of the transformer block 13. As in the case of the transformer block 13, a pair of couplers 100 upstand from the upper end edges of opposite side faces of the casing 14*a* of the transformer block 14, and a pair of secondary lead-out terminals 102 of the transformer extend outward from a substantially central end edge portion of the upper face of the casing of the transformer block 14. As shown in FIG. 25, a raised portion 104 and a depressed portion 104' are formed on one of the side faces of the casing 14*a* so as to be engageable with the mating depressed and raised portions 94 and 94' formed on one of the side faces of the casing 9*a* of the contact block 9.

Figure 1D:
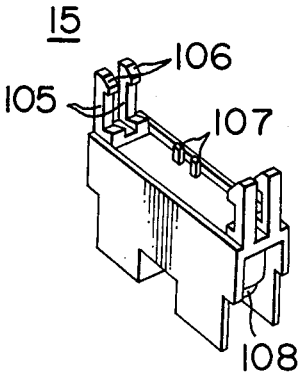

Referring to FIG. 1D, a direct power-supply adapter block 15 is provided with two pairs of couplers 105 which upstand from the upper end edges of opposite side faces respectively of the casing and are formed at their upper ends with respective hook portions 106 directed inward toward each other, so that the adapter block 15 may be releasably coupled with the contact block 9 (or block 9' when it is additionally used), as in the case of the transformer block 13. A pair of lead-out terminals 107 extend outward from an area of the upper face of the casing closer to one of the side faces than the central area of the upper face and are connected at the other end to a pair of input terminals 108 disposed at the lower ends of the respective side faces of the casing of the adapter block 15.

The lead-out terminals 102 (or alternatively 107) may be received in the socket portion (not shown) of the holder 11. When the block 9' is additionally used, the lead-out terminals 102 or 107 are coupled with the socket portion (not shown) of the holder 12 and the lead-out terminals 12*a* of the holder 12 are coupled with the socket portion (not shown) of the holder 11. The lamp holder 11 may be formed of two separable portions, one a lamp socket 11' and the other a conductor holder which is the same as the conductor holder 12.

Figures 2A, 2B, 2C, 2D:
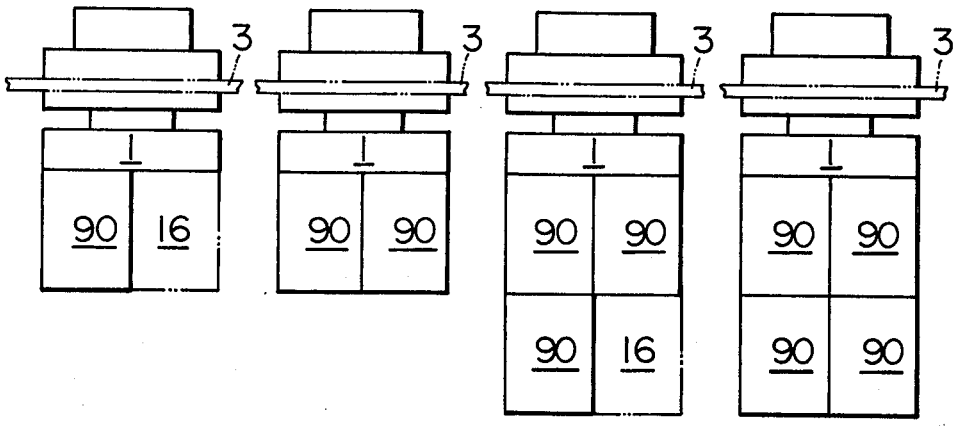
FIGS. 2A to 2P are block diagram-like representations of typical examples of various types of small-size switching apparatus assemblies constructed by combining the individual blocks according to the present invention.
Figures 2E, 2F, 2G:
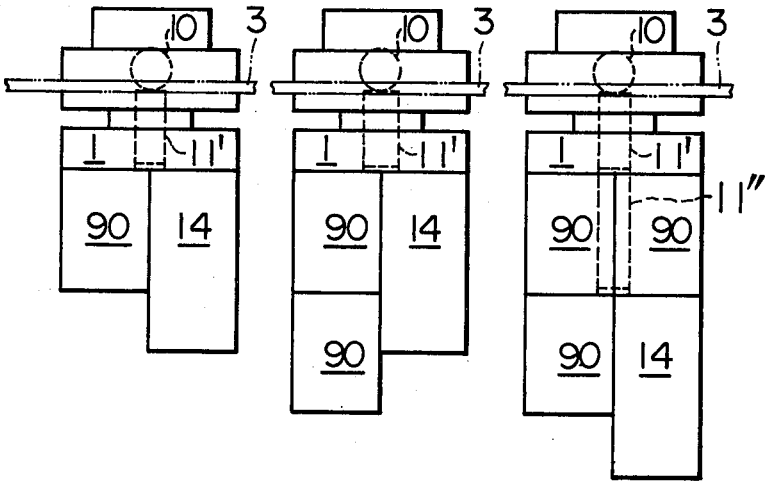
Figure 2H:
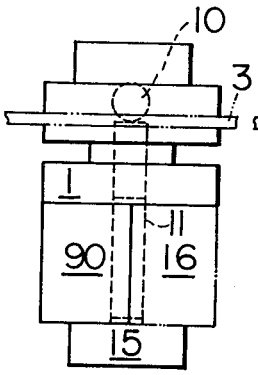
Figure 2I:
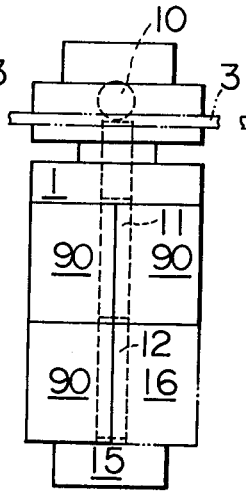
Figure 2J:
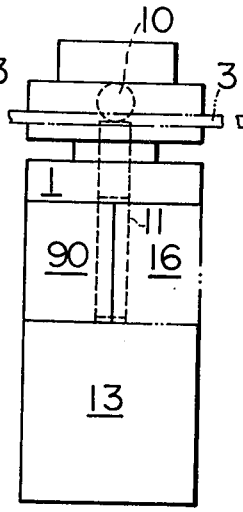
Figure 2K:
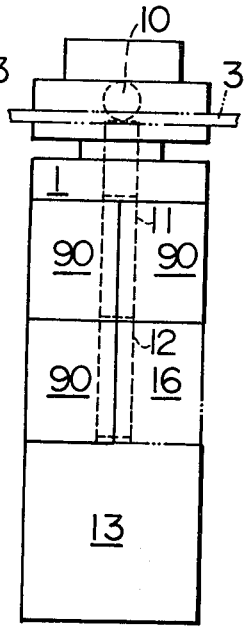
Figure 2L:
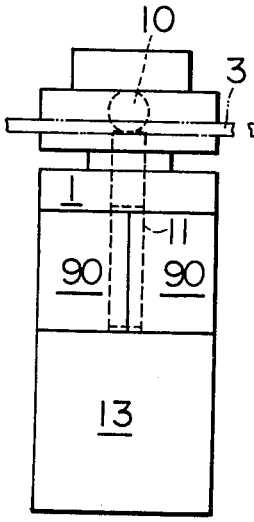
Figure 2M:
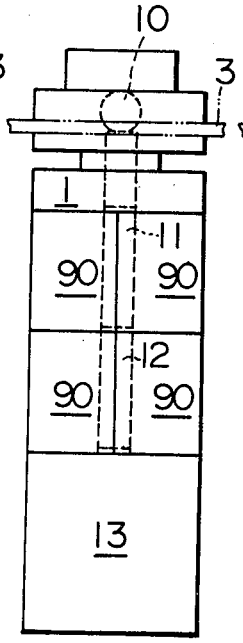
Figure 2N:
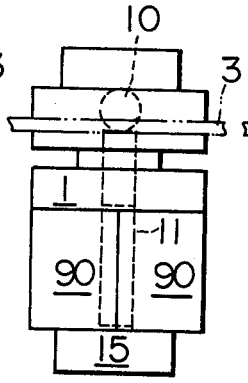
Figure 2P:
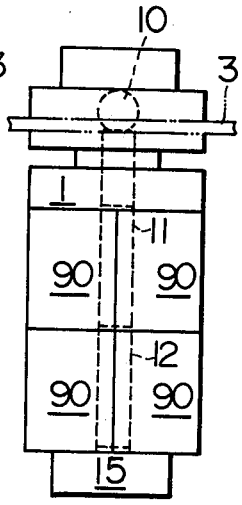

FIGS. 2A to 2P illustrate, in block diagram fashion, typical examples of various types of small-size switching apparatus assemblies constructed by selectively combining the individual blocks according to the present invention. The first group shown in FIGS. 2A to 2D illustrates combinations of the individual blocks for constructing a push button switch assembly, a selector switch assembly and a push button switch assembly of lockable type according to the present invention. The second group shown in FIGS. 2E to 2G illustrates combinations of the individual blocks for constructing a push button switch assembly with illumination and a push button switch assembly of lockable type with illumination according to the present invention. The third group shown in FIGS. 2H to 2K illustrates combinations of the individual blocks for constructing a push button switch assembly with illumination and a push button switch assembly of lockable type with illumination according to the present invention. The fourth group shown in FIGS. 2L to 2P illustrates combinations of the individual blocks for constructing a push button switch assembly with illumination, a push button switch assembly of lockable type with illumination and a selector switch assembly with illumination according to the present invention.

The switch assemblies belonging to the same group have properties or characters analogous to one another. For example, FIG. 2A in the first group illustrates a switch assembly constructed by coupling one contact block section 90 and one dummy block 16 to the actuator block 1, and such a combination provides a push button switch assembly, a selector switch assembly or a push button switch assembly of lockable type depending on the selection of elements of a switch actuator mechanism, described later, to be incorporated in the actuator block 1. The dummy block 16 has the same casing as the casing 9*a* but it does not include any contact mechanism therein.

In the second group, FIG. 2F illustrates a switch assembly constructed by longitudinally coupling two contact block sections 90 and one transformer block 14 of flat type to the actuator block 1 while incorporating an illumination lamp 10 and a lamp socket 11' in the block 1. Such a combination provides a push button switch assembly with illumination on a push button switch assembly of lockable type with illumination depending on the selection of the elements of the switch actuator mechanism, described later, to be incorporated in the actuator block 1.

In the third group, FIG. 2I illustrates a switch assembly constructed by coupling three contact block sections 90 and one dummy block 16 to the actuator block 1 and then coupling the direct power-supply adapter block 15 to the lower end of the stack, while incorporating the illumination lamp 10, lamp holder 11 and connection conductor holder 12 in the blocks 1 and 9. Such a combination provides a push button switch assembly with illumination or a push button switch assembly of lockable type with illumination depending on the selection of the elements of the switch actuator mechanism, described later, to be incorporated in the actuator block 1.

In the fourth group, FIG. 2L illustrates a switch assembly constructed by coupling two contact block sections 90 and one transformer block 13 to the actuator block 1 while incorporating the lamp 10 and lamp holder 11 in the blocks 1 and 9. Such a combination provides a push button switch assembly with illumination, a push button switch assembly of lockable type with illumination or a selector switch assembly with illumination depending on the selection of the elements of the switch actuator mechanism, described later, to be incorporated in the actuator block 1.

Individual embodiments of the switching apparatus assembly according to the present invention will now be described in detail.

Figure 3:
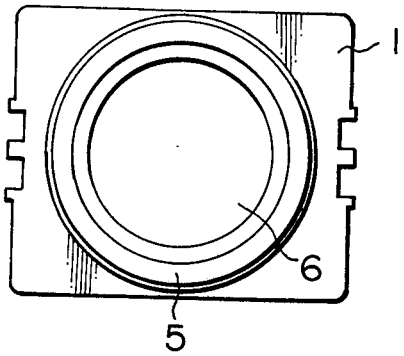
FIG. 3 is a top plan view of an embodiment of the push button switch assembly according to the present invention.
Figure 4:
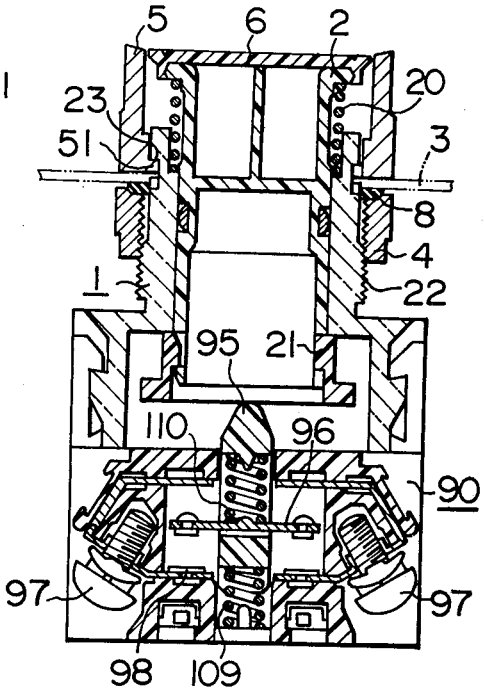
FIG. 4 is a longitudinal sectional elevation view of the push button switch assembly shown in FIG. 3.

FIGS. 3 to 6 show an embodiment of the push button switch assembly according to the present invention. Referring to FIGS. 3 and 4, this push button switch assembly comprises an actuator block 1 which is hollow cylindrical in its front section and hollow box-shaped in its rear section and in which a central accommodation space extends therethrough in its axial direction, as described with reference to FIG. 1A. A hollow cylindrical actuator element 2 is received in this central accommodation space of the actuator block 1 and is capable of making linear movement along the axis of the actuator block 1 and turning movement around the axis of the actuator block 1, as also described with reference to FIG. 1A. The actuator element 2 is normally urged in the forward direction or upward in FIG. 4 by a compression coil spring 20. A push button 6 is fitted on the front or upper end of the actuator element 2, and a pressure imparting member 21 is fitted on the rear or lower end of the actuator element 2. One or two contact block sections 90 as described with reference to FIG. 1B are coupled to the rear or lower end of the actuator block 1, and a follower member or contactor carrying member 95 extending in the forward direction or upward through the central area of the upper face of the casing 9*a* of each contact block section 90 is engaged by the pressure imparting member 21 to be displaced thereby. The member 95 is urged upward by a coil spring 109. A bridging strip or contactor 96 carrying a pair of movable contacts at its opposite ends is supported by the follower member 95 and held in its downwardmost position by a coil spring 110. An associated pair of fixed contacts 98 are respectively electrically connected by conductors to a pair of terminal screws 97 fixed on the contact block casing 9*a*. The members, except the coil springs, terminal screws, contacts, bridging strip and leads which are made of electrically conductive material are made of a plastic resin material such as polyacetal, polycarbonate or nylon.

Such a push button switch assembly is mounted on a panel 3 by use of a panel-thickness adapter ring 4 and a bezel 5 of circular cross section. For the mounting purpose, an externally threaded portion 22 is formed on the portion of the cylindrical section adjacent to the boundary between the cylindrical and box-shaped sections of the casing of the actuator block 1, and a plurality of, for example, four circumferentially equally spaced L-shaped grooves 23 are formed on the portion of the cylinderical section adjacent to the upper end thereof. Also, for this purpose, the circular bezel 5 is formed with four circumferentially equally spaced lugs 51 on its inner peripheral face. The push button switch assembly is mounted in a circular opening of the panel 3 by bringing the panel-thickness adapter ring 4, having a rubber washer 8 fitted in its upper end opening, into threaded engagement with the externally threaded portion 22 of the cylindrical section of the casing of the actuator block 1, inserting the cylindrical section of the casing of the actuator block 1 into the circular opening of the panel 3 from beneath to expose the upper end portion of the cylindrical section of the casing of the actuator block 1 above the upper surface of the panel 3, inserting the lugs 51 of the circular bezel 5 into the respective axially extending portions 23*a* (FIG. 1A) of the L-shaped grooves 23 formed on the cylindrical section of the casing of the actuator block 1 while holding the upper end portion of the cylindrical section of the actuator block casing in the state exposed above the panel 3, and then turning the bezel 5 clockwise to fixedly mount the actuator block 1 on the panel 3. In the push button switch assembly having the structure above described, depression of the push button 6 causes downward displacement of the actuator element 2, hence, downward displacement of the follower member 95 engaged by the pressure imparting member 21 coupled to the actuator element 2, and the fixed contacts 98 are shorted by the bridging strip 96 to turn on the switch. When the force depressing the push button 6 is released, the actuator element 2 is restored to its original position by the force of the coil spring 20, and the follower member 95 is also restored to its original position to turn off the switch by the coil spring 109.

Figure 5:
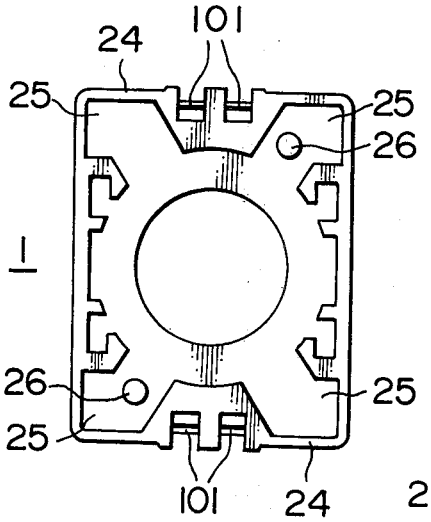
FIG. 5 is a bottom plan view of the actuator block in the push button switch assembly shown in FIG. 3.

Referring to FIG. 5 which is a bottom plan view of the box-shaped section of the actuator block 1, the engaging portions 101 engageable with the associated hook portions 92 of the couplers 91 of the contact block 9 are formed in the middle of the short sides 24 respectively of the rectangular lower end of the box-shaped section of the actuator block 1. A cavity 25 is formed in each of the four corners at that end of the box-shaped section of the actuator block 1, and a pair of projections or pins 26 extend outward into one of the diagonally opposite pairs of the cavities 25 respectively, so that members or elements suitable for carrying out the desired function of the switch actuator mechanism can be selectively disposed in these cavities 25, as will be describe in more detail.

Figure 6:
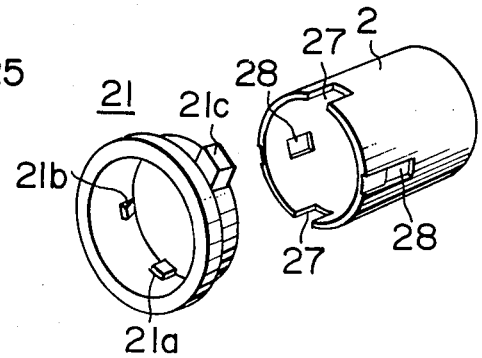
FIG. 6 is an exploded perspective view showing the relation between the actuator element and the pressure imparting member in the push button switch assembly shown in FIG. 3.

FIG. 6 is a perspective view of the rear or lower end portion of the actuator element 2 shown together with the pressure imparting member 21 fitted on that end portion of the actuator element 2. A pair of cutouts 27 are formed at diametrically opposite positions respectively of the rear or lower end edge of the actuator element 2, and a pair of rectangular slots 28 are formed at positions circumferentially spaced by 90° from the respective cutouts 27. A pair of rectangular lugs 21*a* each corresponding to one of the cutouts 27 are formed at diametrically opposite positions on the inner peripheral face of the pressure imparting member 21, and a pair of slant lugs 21*b* each corresponding to one of the rectangular slots 28 are formed at positions circumferentially spaced apart by 90° from the respective lugs 21*a*, so that the pressure imparting member 21 can be coupled to the actuator element 2 by inserting the rear or lower end of the actuator element 2 into the opening of the pressure imparting member 21 and fitting the lugs 21*a* and the lugs 21*b* into the cutouts 27 and the slots 28 respectively. Another lug 21*c* extends radially outward from a front or upper portion of the outer peripheral face of the pressure imparting member 21 to be fitted in one of the cavities 25 formed at the four corners of the box-shaped section of the actuator block 1 so that its can act as a locking means for locking the pressure imparting member 21 against rotation relative to the actuator block 1.

Figure 7:
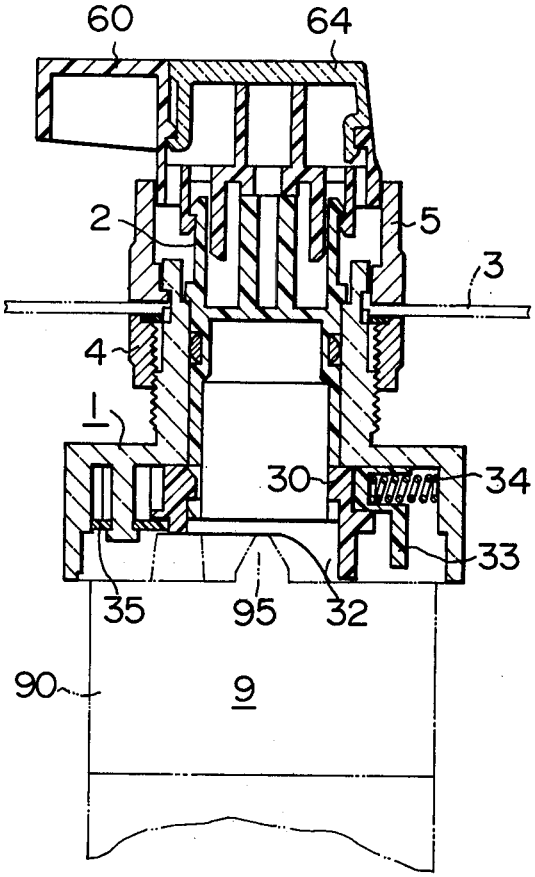
FIG. 7 is a longitudinal sectional elevation view of part of an embodiment of the selector switch assembly according to the present invention.
Figure 8:
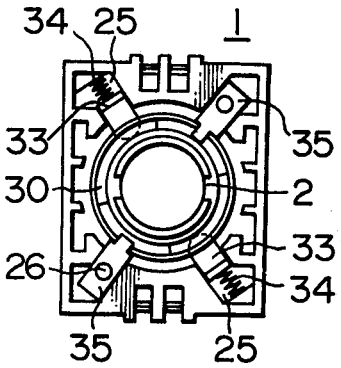
FIG. 8 is a bottom plan view of the actuator block in the selector switch assembly shown in FIG. 7, with the selector switch actuator mechanism being mounted in position.
Figure 9:
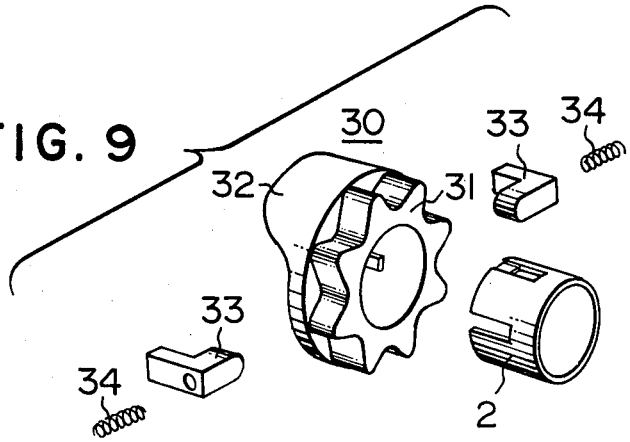
FIG. 9 is an exploded perspective view showing the relation between the selector switch actuator cam and the actuator element in the selector switch assembly shown in FIG. 7.

FIGS. 7 to 9 show a selector switch assembly which is another embodiment of the present invention. An actuator cam member 30 is fitted on the rear or lower end of the actuator element 2. As best shown in FIG. 9, this actuator cam member 30 is formed at its front or upper portion with a plurality of circumferentially equally spaced cam lobes 31 along the entire outer periphery and at its rear or lower portion with a cylindrical cam 32. A pair of notch members 33 and a pair of coil springs 34 for pressing the notch members 33 toward the cam lobes 31 are mounted in one of the diagonally opposite pairs of the cavities 25 respectively in the box-shaped section of the actuator block 1. In the case of the selector switch assembly, the aforementioned coil spring 20 is not provided, and a directional handle 60 is provided in place of the push button 6. A pair of stopper members 35 are mounted on the pins 26 in the other diagonally opposite pair of the cavities 25 respectively. These stopper members 35 serve to limit axial displacement of the actuator element 2. In operation, the follower member 95 engaging with the cylindrical cam 32 of the actuator cam member 30 is displaced depending on the angular position of the actuator element 2 turned by the handle 60, thereby turning on or off the switch. The actuator cam member 30 is stably maintained in its stationary position when the notch members 33 are received in the valleys defined between the cam lobes 31. A direction indication member 64 is provided also for covering the opening of the handle 60 at its top portion.

Figure 10:
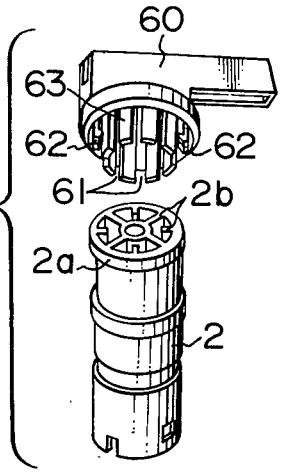
FIG. 10 is a perspective view showing one form of the means for mounting the handle on the actuator element in the selector switch assembly shown in FIG. 7.
Figure 11A:
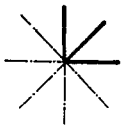
FIGS. 11A to 11C show the relation between the mounted position of the handle and the notch position shifted with the turning movement of the handle in the arrangement shown in FIG. 10.
Figure 11B:
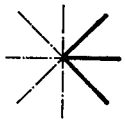
Figure 11C:
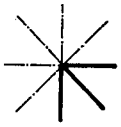

FIG. 10 is a perspective view showing one form of means for mounting the handle 60 on the actuator element 2 in the selector switch assembly shown in FIG. 7, and FIGS. 11A to 11C show the relation between the mounted position of the handle 60 and the notch position shifted with the turning movement of the handle 60 in the arrangement shown in FIG. 10. Referring to FIG. 10, an annular projection **2*a* is provided on the peripheral edge of the upper end opening of the actuator element 2 in the selector switch assembly, and eight circumferentially equally spaced strips 2*b* extend radially inward from the annular projection 2*a* toward the center thereof. A base portion 63 of the handle 60 is formed with slits 61 engageable with the respective strips 2*b* and a pair of hooks 62 engageable with the outer periphery of the annular projection 2*a*. The handle 60 can thus be easily mounted on and detached from the actuator element 2 without requiring a substantial force when the mounting base portion 63 of the handle 60 as well as the actuator element 2 is made of a resilient resin material. The handle 60 can be locked against rotation relative to the actuator element 2 by engagement of the slits 61 with the strips 2*b*. Further, due to the fact that the eight equally spaced strips 2*b* are formed in the annular projection 2*a* of the actuator element 2, the handle 60 can be mounted in any one of the angular positions spaced apart from each other by an angle of 45°. Therefore, when, for example, the selector switch assembly is designed to be switched over three notch positions, the handle 60 can be turned within the range of three notch positions in a plurality of modes as illustrated in FIGS. 11A to 11C**.

Figure 12:
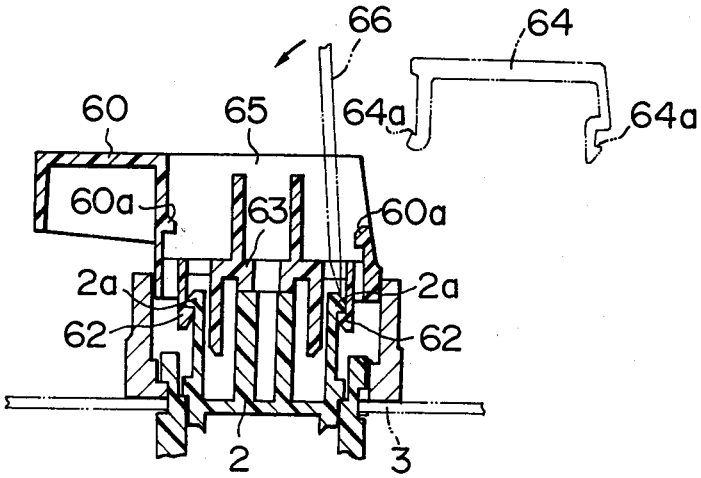
FIG. 12 is a longitudinal sectional view illustrating how the handle is detached from the actuator element in the arrangement shown in FIG. 10.

FIG. 12 illustrates how the handle 60 is detached from the actuator element 2 in the arrangement shown in FIG. 10. Referring to FIG. 12, the direction indication member 64 is formed with a pair of hook portions **64*a* at opposite ends respectively so as to be respectively releasably engageable with a pair of mating hook portions 60*a* formed on the body of the handle 60. The handle 60 mounted on the actuator element 2 can be detached from the position by removing the direction indication member 64 first from the handle 60 inserting then a tool such as a screw driver 66 through the aperture 65 and inclining the driver 66 in a direction as shown by the arrow thereby releasing the engagement between the handle 60 and the actuator element 2**.

FIGS. 13 to 15 show a push button switch assembly of lockable type which is still another embodiment of the present invention. A pressure imparting member 40, in lieu of the aforementioned pressure imparting member 21, is fitted on the rear or lower end of the actuator element 2 and is formed with a pair of flange portions 41 each extending over a predetermined angle. A pair of locking elements 42 are disposed respectively in one of the diagonally opposite pairs of the cavities 25 formed at the four corners of the box-shaped section of the actuator block 1. Each locking element 42 includes a locking pawl 45 outward urged by a coil spring 44 within a housing 43 which is in the form of a hollow rectangular parallelepiped, as shown in FIG. 15. When the flange portions 41 of the pressure imparting member 40 move toward and abut against the respective locking pawls 45 in a direction as shown by the arrow A in FIG. 15, the respective locking pawls 45 are urged inward by the flange portions 41 against the force of the springs 44, and the flange portions 41 ride over the respective sloped faces of the locking pawls 45 so that the pressure imparting member 40 can be downward displaced. When, on the contrary, the pressure applied onto the actuator element 2 is removed and each of the flange portions 41 is to be moved by the spring 20 toward the associated locking pawl 45 in a direction as shown by the arrow B in FIG. 15, the vertical face of the locking pawl 45 engages with the flange portion 41 thereby preventing the pressure imparting member 40 from returning to its initial position and locking it at its pushed position.

In the case of this push button switch assembly of lockable type, a manipulating handle such as a directional handle or a mushroom-shaped handle 6' as shown in FIG. 13 is employed in lieu of the aforementioned push button 6. In operation, when the actuator element 2 is displaced as a result of depression of the handle 6, the pressure imparting member 40 acts to turn on the switch, and the switch assembly is locked in the on state since, at this time, the respective flange portions 41 of the pressure imparting member 40 have ridden over the locking pawls 45, and the actuator element 2 is locked against returning movement even when the force imparted to the actuator element 2 is released. Then, when the actuator element 2 is turned until the cutout portions lying between the flange portions 41 of the pressure imparting member 40 are brought to the positions of the locking pawls 45, the flange portions 41 of the pressure imparting member 40 are now freely movable in the returning direction thereby restoring the switch to its off state. A torsion coil spring 46 causes the returning movement of the actuator element 2 toward the original angular position from the turned position when the turning pressure has been released, and the aforementioned coil spring 20 causes the returning movement of the actuator element 2 toward the original vertical position from the axially displaced position. A stopper member 47 as shown in FIG. 15 may be mounted on the pin 26 in one of the remaining cavities 25 in the box-shaped section of the actuator block 1 so that the actuator element 2 may not be excessively turned after it has been released from the locked angular position.

Figure 16:
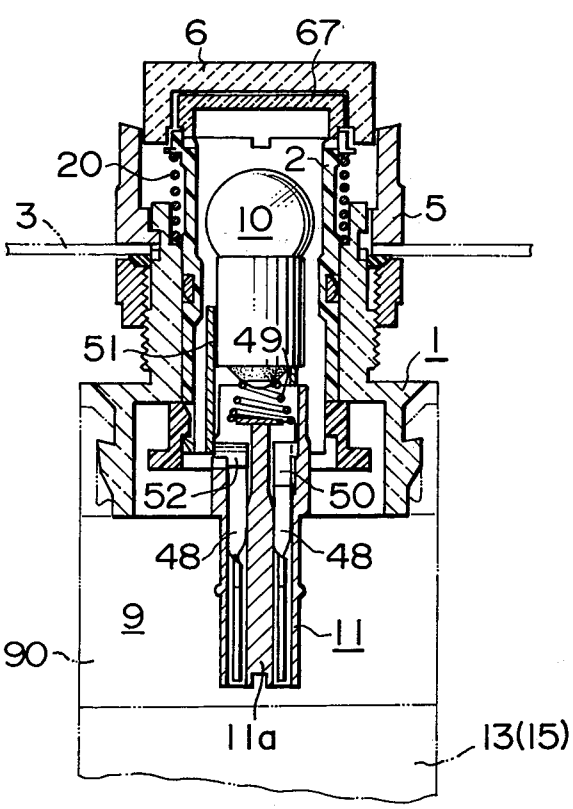
FIG. 16 is a longitudinal sectional elevation view of part of an embodiment of the push button switch assembly with illumination according to the present invention.

FIG. 16 shows a push button switch assembly with illumination which is yet another embodiment of the present invention. The structure of this embodiment is generally similar to that of the push button switch assembly described with reference to FIG. 4. In this push button switch assembly with illumination, an illumination unit including an illumination lamp 10 supported on a lamp holder 11 as shown in FIG. 1B is inserted into the reception space 9b defined between the two contact block casings 9a (FIG. 1B) to be fixedly supported therein, and the contact block sections 90 having the illumination unit held therebetween are coupled to the actuator block 1 having the push button switch actuator mechanism shown in FIG. 4. The lamp holder 11 includes a central separator 11a which acts to electrically insulate a pair of conductor strips 48 from each other. One of the conductor strips 48 is connected to a contact strip 50 formed at its upper end with a receptor for a conical coil spring 49 engaging with the conductive portion at the lower end of the lamp 10, while the other conductor strip 48 is connected to a contact strip 52 mounted directly on a lamp socket 51. The transformer block 13 or the direct power-supply adapter block 15 shown by the two-dot chain lines is coupled to the lower end of the joined contact block sections 90 shown also by the two-dot chain lines. When the direct power-supply adapter block 15 is coupled, the lamp 10 is energized by the full voltage of a power source connected to the terminals 108 of the adapter block 15 shown in FIG. 1D. The numeral 67 designates a switch name plate.

Figure 17:
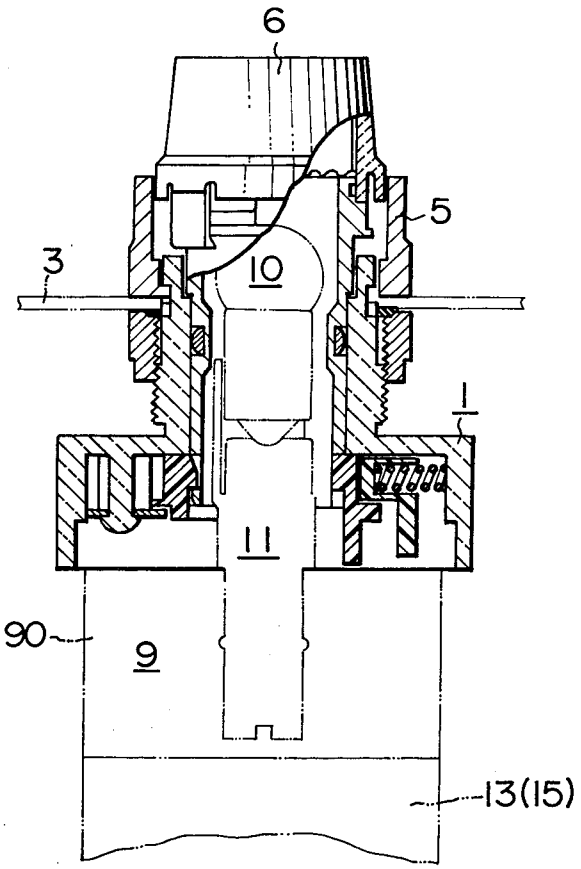
FIG. 17 is a partly cut-away, longitudinal sectional elevation view of part of an embodiment of the selector switch assembly with illumination according to the present invention.

FIG. 17 shows a selector switch assembly with illumination which is another embodiment of the present invention. The structure of this embodiment is generally similar to that of the selector switch assembly described with reference to FIG. 7. The manner of constructing this selector switch assembly with illumination is entirely similar to the manner of constructing the aforementioned push button switch assembly with illumination, and the contact block sections 90 holding therebetween the illumination unit provided by the combination of the lamp 10 and lamp holder 11 are coupled to the actuator block 1 having the selector switch acuator mechanism shown in FIG. 7. The transformer block 13 or the direct power-supply adapter block 15 shown by the two-dot chain lines is coupled to the lower end of the joined contact block 9 shown also by the two-dot chain lines. When the direct power-supply adapter block 15 is coupled, the lamp 10 is energized by the full voltage of a power source connected to the terminals 108 of the adapter block 15.

It is apparent that a push button switch assembly of lockable type with illumination can be provided when the illumination unit shown by the two-dot chain lines in FIG. 13 is similarly mounted in the push button switch assembly of lockable type described with reference to FIG. 13.

Figure 18:
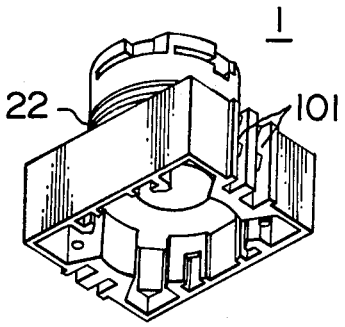
FIG. 18 is a perspective view of a preferred form of the actuator block employed in the present invention, when looked from the bottom side.
Figure 19:
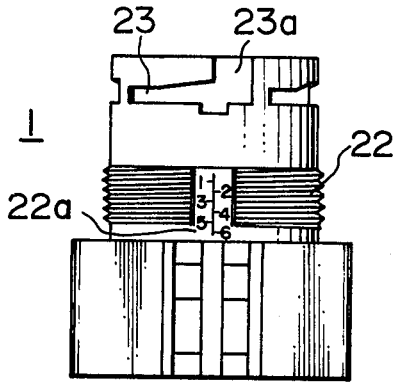
FIG. 19 is an elevation view of the actuator block shown in FIG. 18.
Figure 20:
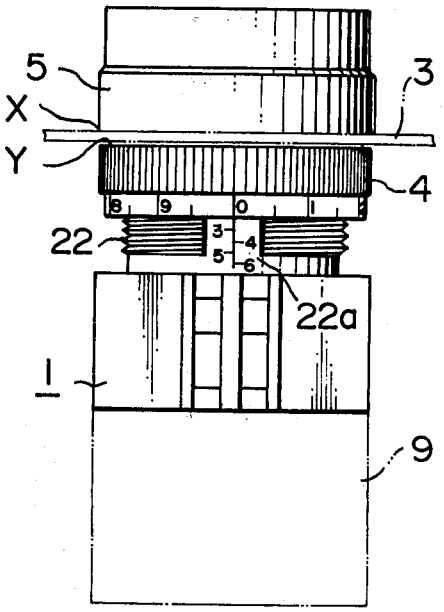
FIG. 20 is an elevation view showing the actuator block shown in FIG. 18 in the position mounted on a panel.

FIG. 18 is a perspective view of a preferred form of the casing portion of the actuator block 1 (without having the actuator element) employed in the present invention when looked from the underside, FIG. 19 is an elevational view of the casing portion of the actuator block 1 shown in FIG. 18, and FIG. 20 is an elevational view showing the actuator block 1 in the state mounted on the panel 3 by the mounting means employed in the present invention. According to the present invention, an externally threaded portion 22 threaded at a predetermined pitch except a portion 22a is formed on the cylindrical section of the casing of the actuator block 1 as described with reference to FIG. 4, and the panel-thickness adapter ring 4 threaded at its inner peripheral face is fitted to make threaded engagement with this threaded portion 22 of the adapter block 1. A scale indicating millimeter values representing various thicknesses of the panel 3 is marked on the non-threaded portion 22a of the cylindrical section of the actuator block 1, and ten circumferentially equally spaced graduations are provided along the lower peripheral end edge of the panel-thickness adapter ring 4. Thus, when the panel-thickness adapter ring 4 is screwed down on the cylindrical section of the actuator block 1 to the position corresponding to the actual thickness of the panel 3 to be sandwiched between the lower end face X of the bezel 5 and the upper end face Y of the panel-thickness adapter ring 4, the actuator block 1 can be very easily mounted on the panel 3 without requiring any adjustment.

Figure 21:
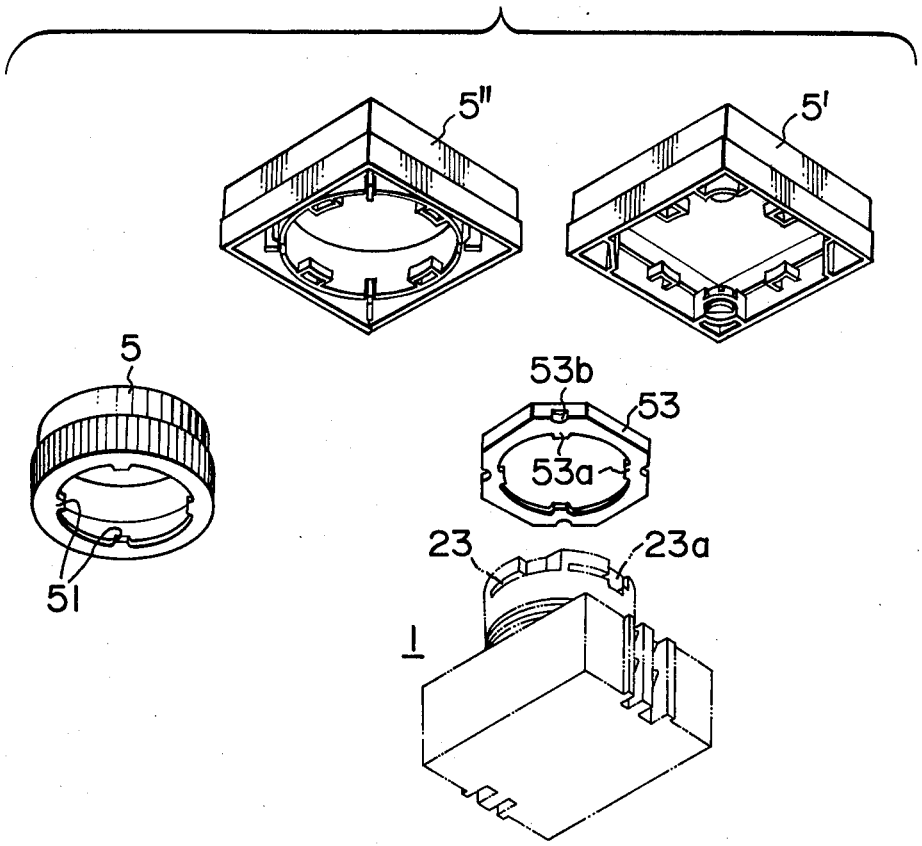
FIG. 21 is a perspective view showing the relation between the actuator block shown in FIG. 18 and various kinds of bezels preferably employed in the present invention.
Figure 22A:
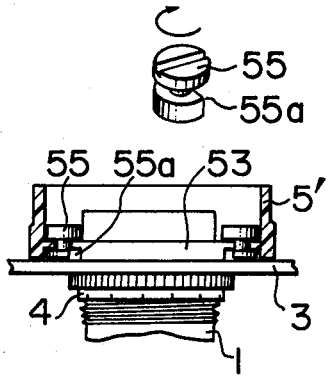
FIGS. 22A and 22B illustrate how the actuator block shown in FIG. 18 is mounted on the panel by the square bezel shown in FIG. 21.
Figure 22B:
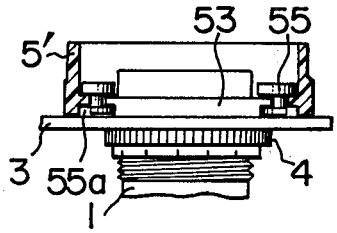

FIG. 21 shows various kinds of bezels preferably employed in the present invention, and FIGS. 22A and 22B illustrate how the actuator block 1 is mounted on the panel 3 by the square bezel 5' shown in FIG. 21. As described already, the actuator block 1 is mounted on the panel 3 by sandwiching the panel 3 between the panel-thickness adapter ring 4 and the bezel 5, according to the present invention. When the circular bezel 5 shown in FIG. 21 is used for mounting the actuator block 1 on the panel 3, a plurality of, for example, four projections 51 formed in circumferentially equally spaced apart relation on the inner peripheral face of the bezel 5 are each fitted in the axially extending portions 23a of the L-shaped grooves 23 of the actuator block 1, and then, the bezel 5 is turned clockwise to fasten the actuator block 1 to the panel 3, as described with reference to FIG. 4.

For the purpose of mounting the actuator block 1 on the panel 3 by the square bezel 5' or square-circular bezel 5'', an octagonal nut 53 is used which is formed at its inner peripheral face with four circumferentially equally spaced projections 53a and at its lower face with four equally spaced cutouts 53b, as shown in FIG. 21. The projections 53a of this octagonal nut 53 are previously fitted in the L-shaped grooves 23 of the actuator block 1. In the case of, for example, the square-circular bezel 5'', hook portions 54 extend downward from the areas adjacent to the four corners of the bezel 5'' to engage respectively with the cutouts 53b of the octagonal nut 53, and four projections 54a extend radially inward from the internal circumference at the positions corresponding respectively to the axially extending portions 23a of the L-shaped grooves 23 of the actuator block 1 so as to be utilized for the positioning of the bezel 5''.

Referring to FIGS. 22A and 22B showing the manner of mounting the actuator block 1 on the panel 3 by the square bezel 5', a cam member 55 having a semi-circular cam 55a is disposed rotatably in each of the four corner areas of the bezel 5' opposite to the associated cutout 53b of the octagonal nut 53 when the nut 53 is inserted in position, and then, a tool such as a screw driver is used to turn each of the cams 55a of the cam members 55 through an angle of 180° so as to lock the nut 53 against escapement.

Figure 23:
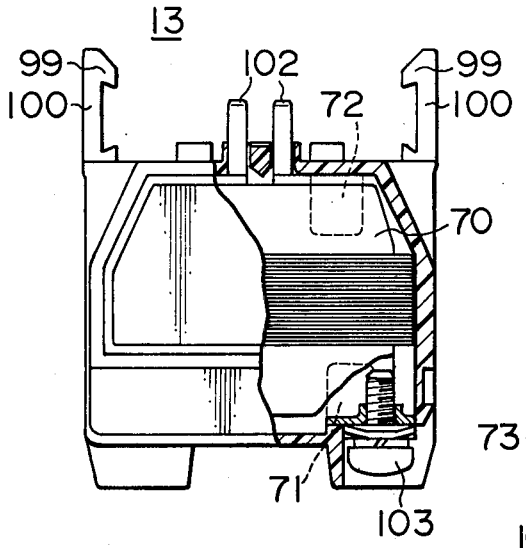
FIG. 23 is a partly cut-away, longitudinal sectional elevation view of one form of the transformer block employed in the present invention.

FIG. 23 is a partly cut-away, longitudinal sectional elevation view of one form of the transformer block 13 preferably employed in the present invention. Referring to FIG. 23, this transformer block 13 comprises a transformer composed of a laminated core, a bobbin 70 mounted on the core and a coil wound around the bobbin. The input terminals 103 are respectively connected to the terminal plates 71 connected to the primary side of the transformer and disposed at a position lower relative to the core in the bobbin 70, and the secondary or lead-out terminals 102 protruding at their upper ends from the casing are respectively connected to the terminal plates 72 connected to the secondary side of the transformer and disposed at a position upper relative to the core in the bobbin 70. As described already with reference to FIG. 1B, two pairs of opposite couplers 100 upstand from the opposite sides of the upper face of the casing of the transformer block 13. The lead-out terminals 102 protruding at their upper ends from the casing are generally connected to the socket (not shown) provided at the lower end of the lamp holder 11 or to the socket (not shown) provided at the lower end of the connection conductor holder 12 shown in FIG. 1B.

Figure 24:
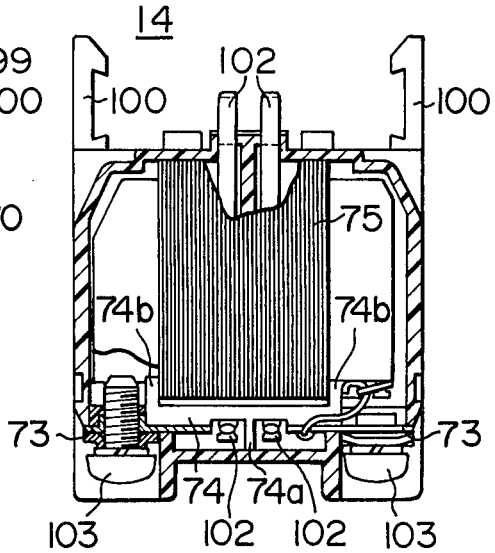
FIG. 24 is a partly cut-away, longitudinal sectional elevation view of one form of the transformer block employed in the present invention.

FIG. 24 is a partly cut-away, longitudinal sectional elevation view of one form of the transformer block 14 preferably employed in the present invention, and FIG. 25 is a partly cut-away, bottom plan view of the transformer block 14 shown in FIG. 24. In order that this transformer block 14 has a shape more flattened than the transformer block 13, the terminal plates 73 which are connected to the primary side of the transformer and to which the input terminals 103 are connected, are mounted on a terminal support 74 formed with an electrical insulating barriers 74*a*, and these terminal plates 73 are disposed on the same side as the disposed side of the corresponding lead-out terminals 102 or on the lower side of FIG. 24. The terminal support 74 has a sectional shape in the form of Y as shown in FIG. 24, and a pair of spaced side arms 74*b* extend in a direction opposite to the extending direction of the insulating barrier 74*a* to hold a laminated core 75 press-fitted therebetween. The terminal support 74 can be inserted into the casing together with the bobbin and other members in the state holding the core 75 between its side arms 74*b*. Therefore, the transformer block 14 can be very easily assembled because, after making all the necessary connections connecting the input terminals and lead-out terminals to the coil terminals at the exterior of the casing, the terminal support 74 having the core 75 press-fitted between its side arms 74*b* can be inserted into the casing. As also described already with reference to FIG. 1C, a pair of couplers 100 upstand from the opposite sides of the upper face of the casing of the transformer block 14, and the lead-out terminals 102 project at their upper ends from the front face of the casing. Further, a raised portion 104 and a depressed portion 104' are formed on the front face of the casing of the transformer block 14 to be respectively engageable with the mating depressed and raised portions 94 and 94' formed on the side face of the casing 9*a* of the contact block section 90.

Figure 26:
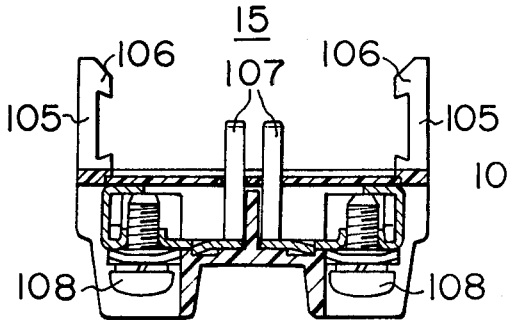
FIG. 26 is a longitudinal sectional elevation view of one form of the direct power-supply adapter block employed in the present invention.

FIG. 26 is a longitudinal sectional elevation view of one form of the direct power-supply adapter block 15 preferably employed in the present invention. As in the case of the transformer block 13, two pairs of opposite couplers 105 each having a hook portion 106 formed at its upper end upstand from the opposite sides of the upper face of the casing of the adapter block 15. A pair of lead-out terminals 107 extend at their upper ends from an area of the upper face of the casing closer to one of the side faces than the central area of the upper face and are connected at the other end to a pair of input terminals 108 disposed at the lower ends of the side faces respectively of the casing of the adapter block 15, as described with reference to FIG. 1D.

It will be understood from the foregoing detailed description of the present invention that a plurality of various kinds of blocks including actuator blocks, contact block sections, transformer blocks and direct power-supply adapter blocks are previously prepared as independent units which can be coupled together into a releasably interlocked structure, and any desired one of small-size switching apparatus assemblies including a push button switch assembly, a selector switch assembly, a push button switch assembly of lockable type, a push button switch assembly with illumination, a selector switch assembly with illumination, and a push button switch assembly of lockable type with illumination may be easily constructed by properly assembling suitable ones of the blocks mentioned above. The present invention can therefore greatly reduce the number of required parts compared with the prior art in which different designs have been required for different types of such switch assemblies and specific parts have been used for assembling the individual switch assemblies. The present invention is also very advantageous over the prior art from the viewpoints of production management and stock management.

According to the present invention, cavities are formed at the four corners of the box-shaped section of the casing of the actuator block so as to be capable of accommodation of various parts or members, and various switch actuator means are connected to the rear or lower end of the actuator element. In the present invention, various members including notch members, locking elements, stopper members and guide pins are selectively mounted in the cavities formed at the four corners of the box-shaped section of the actuator block, and various members including actuator cam members and pressure imparting members of various shapes are selectively connected to the rear or lower end of the actuator element, so that the single actuator block can be used in common for the assembling of the various small-size switching apparatus assemblies such as the push button switch assembly, the push button switch assembly of lockable type, the selector switch assembly and the push button switch assembly with illumination. The present invention can therefore greatly reduce the costs of manufacture in addition to the great reduction in the number of required parts.

The prior art switch assemblies have been manufactured with low efficiency of assembling due to the requirement for assembling of specific parts differing depending on the switch type, and many steps including the step of screwing and the step of caulking have been required for the coupling and fixing of the individual parts. In contrast, the present invention can greatly improve the efficiency of assembling since the individual blocks can be selectively coupled together to provide any desired one of the various switching apparatus assemblies.

We claim:

1. A switching apparatus assembly structure having a central axis and comprising at least one first block provided with a contact mechanism and adapted to be coupled to others in a multi-stage fashion, and a second block provided with an actuator mechanism for actuating said contact mechanism, said first block and said second block being detachably coupled to each other in the direction of said central axis, wherein (A) said first block comprises:

(a) a first casing of a generally box-like form having its central axis registering with said central axis, (b) at least one electrical contact means accommodated within said first casing, (c) external lead-out terminal means electrically connected to said contact means, and (d) first engaging means provided on said first casing for detachably coupling said first block to another block to be adjoined to said first block in the direction of said central axis; and wherein (B) said second block comprises:

(a) a second casing having its central axis registering with said central axis, said second casing including a hollow box-shaped section and a hollow cylindrical section extending from said box-shaped section in the direction of said central axis, said box-shaped section opening in a direction remote from said cylindrical section with respect to said central axis to define a hollow space divided into a substantially circular central cavity and small cavities located at the four corners of said box-shaped section and communicating with said central cavity, the hollow space of said cylindrical section and the central cavity of said box-shaped section communicating with each other to define an accommodation space extending through said second casing in the axial direction, (b) manually-operated cylindrical actuator means movably accommodated within said accommodation space for turning on and off said contact means by actuating the same, and (c) second engaging means cooperating with said first engaging means for detachably coupling said second block to said first block adjoining thereto.

2. A switching apparatus assembly structure as claimed in claim 1, wherein said contact means includes at least one pair of fixed contacts disposed in a relation spaced apart from each other within said first casing, a bridging strip for establishing an electrical connection between the pair of said fixed contacts, a follower member in the form of a bar carrying said bridging strip and supported within said first casing so as to be movable in the axial direction between a first axial position where said first contacts are electrically connected by said bridging strip and a second axial position where said fixed contacts are not electrically connected by said bridging strip, and first biasing means for normally biasing said follower member toward one of said first and second axial positions, one end of said follower member normally projecting outward from said first casing when said follower member is in said one of said first and second axial positions, while said follower member being urged toward the other of said first and second axial positions against the force of said first biasing means when pressure is imparted to said one end by said cylindrical actuator means.

3. A switching apparatus assembly structure as claimed in claim 2, wherein said cylindrical actuator means is supported so as to be movable between a third axial position and a fourth axial position and includes second biasing means for normally biasing said cylindrical actuator means toward said third axial position, said cylindrical actuator means imparting pressure to said one end of said follower member thereby moving the same toward the other of said first and second axial positions when said cylindrical actuator means is urged from said third axial position toward said fourth axial position against the force of said second biasing means.

4. A switching apparatus assembly structure as claimed in claim 3, wherein said cylindrical actuator means is supported so as to be also rotatably with respect to said central axis, and wherein said second block includes means for locking said cylindrical actuator means against axial movement, said cylindrical actuator means being locked in said fourth axial position by said locking means when it is urged from said third axial position, while said cylindrical actuator means being unlocked when it is turned through a predetermined angle.

5. A switching apparatus assembly structure as claimed in claim 4, wherein said cylindrical actuator means is supported so as to be rotatable with respect to said central axis between a first angular position and a second angular position and includes third biasing means for normally biasing said cylindrical actuator means toward said first angular position, said cylindrical actuator means being locked in said fourth axial position by said locking means when it is urged toward said fourth axial position while it is in said first angular position, while said cylindrical actuator means being unlocked when it is turned to said second angular position while it is in said fourth axial position in which it is locked against axial movement by said locking means.

6. A switching apparatus assembly structure as claimed in claim 5, wherein said cylindrical actuator means includes a first cylindrical member and a second cylindrical member detachably connected to one end of said first cylindrical member, said second cylindrical member being formed at its free end with at least one radially outwardly extending flange portion acting to urge said follower member toward the other of said first and second axial positions when pressure is imparted to the other end of said first cylindrical member in that direction against the force of said second biasing means, and said locking means includes a locking member disposed in at least one of said four small cavities in said second casing so as to be radially movable between a first radial position and a second radial position, and fourth biasing means for normally biasing said locking member radially inward toward said first radial position, said locking member being so shaped that said locking member is urged toward said second radial position by the outer peripheral edge of said flange portion against the force of said fourth biasing means to permit advancing movement of said flange portion in the axial direction when said cylindrical actuator means is urged toward said fourth axial position, while said locking member locks said flange portion at said fourth axial position to prevent said cylindrical actuator means from being returned from said fourth axial position toward said third axial position by the force of said second biasing means because said flange portion rides over said locking member which is returned to said first radial position by the force of said fourth biasing means, the circumferential length of said flange portion being selected so that said flange portion is disengaged from said locking member and said locking member no longer locks said flange portion against its axial movement when said cylindrical actuator means is turned toward said second angular position against the force of said third biasing means, a stopper member being disposed in another of said four small cavities in said second block, said stopper member acting to engage with one of the circumferential ends of said flange portion thereby limiting further movement of said flange portion so that said cylindrical actuator means may not be turned beyond said second angular position when it is turned toward said second angular position from said first angular position.

7. A switching apparatus assembly structure as claimed in claim 6, wherein a pair of said contact means of similar structure are provided within said first casing, and said flange portion is also formed for each of the follower members included in the pair of said contact means respectively, so that said two flange portions act to simultaneously urge said follower members toward the other of said first and second axial positions respectively when said cylindrical actuator means is urged toward said fourth axial position from said third axial position.

8. A switching apparatus assembly structure as claimed in claim 7, wherein said follower members included respectively in the pair of said contact means as well as said two flange portions are disposed respectively at opposite positions with respect to said central axis, and a pair of said locking means of similar structure are also provided in such a relation that said locking members in said locking means are associated with said flange portions respectively, said locking members being disposed respectively in the two opposit small cavities with respect to said central axis among said four small cavities formed in said second casing.

9. A switching apparatus assembly structure as claimed in claim 2, wherein said cylindrical actuator means is supported so as to be rotatable with respect to said central axis and is shaped so as to impart pressure to one end of said follower member at a predetermined angular position thereby urging said follower member toward the other of said first and second axial positions.

10. A switching apparatus assembly structure as claimed in claim 9, further comprising means for stabilizing said cylindrical actuator means in a stationary state when it is in at least one predetermined angular position.

11. A switching apparatus assembly structure as claimed in claim 10, wherein said cylindrical actuator means includes a first cylindrical member and a second cylindrical member detachably connected to one end of said first cylindrical member, said second cylindrical member being provided at its free end with an axially outwardly projecting portion for imparting pressure to said follower member thereby urging said follower member toward the other of said first and second axial positions when said cylindrical actuator means is in said predetermined angular position, and said stabilizing means includes a pair of stabilizing members disposed so as to be respectively radially movable in the two small cavities opposite to each other with respect to said central axis among said four small cavities formed in said second casing, and a pair of biasing means for normally biasing the pair of said stabilizing members radially inward respectively, said second cylindrical member being circumferentially continuously corrugated to form a plurality of spaced lobes on its outer peripheral face, and the pair of said stabilizing members being seated at their inner end on the diametrically opposite valley portions between said lobes for stabilizing said cylindrical actuator means in the stationary state.

12. A switching apparatus assembly structure as claimed in claim 11, wherein said cylindrical actuator means further includes a handle member detachably mounted on the other end of said first cylindrical member.

13. A switching apparatus assembly structure as claimed in claim 12, wherein said handle member is of the directional type which can indicate the angular position of said cylindrical actuator means.

14. A switching apparatus assembly structure as claimed in claim 13, wherein said handle member of the directional type can be mounted on said first cylindrical member at any desired one of a plurality of circumferential positions.

15. A switching apparatus assembly structure as claimed in claim 10, wherein said second block includes a pair of stopper members disposed respectively in the remaining pair of said small cavities other than the pair of said small cavities in which the pair of said stabilizing members are disposed respectively, and said second cylindrical member includes a circumferential flange portion projecting radially outward therefrom, said flange portion being rotatably supported between said stopper member pair and said stabilizing member pair to limit free movement of said cylindrical actuator means in the axial direction.

16. A switching apparatus assembly structure as claimed in claim 11, wherein a pair of said contact means of similar structure are provided within said first casing, and said means for stabilizing said cylindrical actuator means in the stationary state is adapted to stabilize said cylindrical actuator means in the stationary state in at least two angular positions of said cylindrical actuator means, and said axially outwardly projecting portion of said second cylindrical member acts to alternatively impart pressure to said follower members included respectively in the pair of said contact means when said cylindrical actuator means is selectively in said two predetermined angular positions.

17. A switching apparatus assembly structure as claimed in claim 1, 2, 3, 4, 5, 6, 7, 8, 9, 10, 11, 12, 13, 14, 15 or 16, further comprising illumination means fixedly supported within the internal space of said cylindrical actuator means to be independent of the movement of said cylindrical actuator means, and a third block detachably coupled to said first block on the side remote from said second block in the direction of said central axis, said third block including a third casing having its central axis registering with said central axis, third engaging means disengageably engageable with said first engaging means of said first block, power input terminal means for receiving electric power externally supplied to energize said illumination means, power output terminal means for supplying the electric power to said illumination means, and connection means for electrically connecting said external power input terminal means to said power output terminal means, and said illumination means including light emitting means supported within the internal space of said cylindrical actuator means, and conductor means extending through a reception space extending through said first casing in the axial direction and communicating with the internal space of said cylindrical actuator means, for electrically connecting said light emitting means to said power output terminal means.

18. A switching apparatus assembly structure as claimed in claim 17, wherein said electrical connection means is electrical conductor means.

19. A switching apparatus assembly structure as claimed in claim 17, wherein said electrical connection means includes transformer means connected at its primary side to said external power input terminal means and at its secondary side to said power output terminal means.

20. A switching apparatus assembly structure as claimed in claim 1, 2, 3, 4, 5, 6, 9, 10, 11, 12, 13, 14 or 15, wherein said first casing includes a first casing section and a second casing section each of which is provided with said first engaging means and which have a first side face and a second side face respectively lying substantially in an imaginary plane including said central axis, and said first and second side faces are formed with means for establishing disengageable engagement between said first and second casing sections, said at least one contact means being accommodated within a selected one of said first and second casing sections.

21. A switching apparatus assembly structure as claimed in claim 20, further comprising illumination means fixedly supported within the internal space of said cylindrical actuator means to be independent of the movement of said cylindrical actuator means, external power input terminal means and power output terminal means disposed in the other of said first and second casing sections for energizing said illumination means by supplying externally supplied electric power to said illumination means, connection means for electrically connecting said external power input terminal means to said power output terminal means, and conductor means for electrically connecting said illumination means to said power output terminal means.

22. A switching apparatus assembly structure as claimed in claim 21, wherein said electrical connection means is electrical conductor means.

23. A switching apparatus assembly structure as claimed in claim 22, wherein said electrical connection means includes transformer means connected at its primary side to said external power input terminal means and at its secondary side to said power output terminal means.

24. A switching apparatus assembly structure as claimed in claim 20, wherein said contact means is disposed within each of said first and second casing sections, and said switching apparatus assembly structure further comprises illumination means fixedly supported within the internal space of said cylindrical actuator means to be independent of the movement of said cylindrical actuator means, and a third block detachably coupled to said first and second casing sections of said first block on the side remote from said second block in the direction of said central axis, said third block including a third casing having its central axis registering with said central axis, third engaging means disengageably engageable with said first engaging means of said first and second casing sections, external power input terminal means for receiving electric power externally supplied to energize said illumination means, power output terminal means for supplying the electric power to said illumination means, and connection means for electrically connecting said external power input terminal means to said power output terminal means, and said illumination means including light emitting means supported within the internal space of said cylindrical actuator means, and conductor means extending through a reception space extending between said first and second side faces of said first and second casing sections in the direction of said central axis and communicating with the internal space of said cylindrical actuator means, for electrically connecting said light emitting means to said power output terminal means.

25. A switching apparatus assembly structure as claimed in claim 24, wherein said electrical connection means is electrical conductor means.

26. A switching apparatus assembly structure as claimed in claim 24, wherein said electrical connection means includes transformer means connected at its primary side to said external power input terminal means and at its secondary side to said power output terminal means.

27. A switching apparatus assembly structure is claimed in claim 1, 2, 3, 4, 5, 6, 7, 8, 9, 10, 11, 12, 13, 14, 15 or 16, wherein said second block includes means for mounting said switching apparatus assembly structure on panel means when said switching apparatus assembly structure is to be used in combination with said panel means.

28. A switching apparatus assembly structure as claimed in claim 27, wherein said mounting means includes a first ring member internally threaded for making screw threaded engagement with an externally threaded portion of said cylindrical section of said second casing, at least one L-shaped groove provided adjacent to the free end of said cylindrical section of said second casing, and a second ring member having at least one projection extending radially inward from its inner peripheral face, said radially inwardly extending projection of said second ring member being engaged in said L-shaped groove of said second casing for rigidly holding said panel means between said first and second ring members.

29. A switching apparatus assembly structure as claimed in claim 28, wherein an axially extending scale is provided on said externally threaded portion of said cylindrical section of said second casing so that said first ring member can be previously disposed in a given position corresponding to the thickness of said panel means.

* * * * *